United States Patent [19]

Molitor

[11] 4,407,266

[45] Oct. 4, 1983

[54] METHOD OF AND APPARATUS FOR EXHAUST CONTROL AND SUPPLYING TEMPERED MAKEUP AIR FOR A GREASE EXTRACTION VENTILATOR

[75] Inventor: Victor D. Molitor, Denver, Colo.

[73] Assignee: Molitor Industries, Inc., Englewood, Colo.

[21] Appl. No.: 286,616

[22] Filed: Jul. 24, 1981

[51] Int. Cl.[3] ..... F24C 15/20

[52] U.S. Cl. ..... 126/299 D; 126/299 E; 165/103

[58] Field of Search ..... 55/DIG. 36; 126/299 D, 126/299 E, 299 F; 165/100, 103, 166

[56] References Cited

U.S. PATENT DOCUMENTS

| | | | |
|---|---|---|---|
| 3,194,308 | 7/1965 | Haried | 165/165 |
| 3,890,887 | 6/1975 | Kaufman et al. | 126/299 D |
| 4,071,080 | 1/1978 | Bridgers | 165/59 |
| 4,122,834 | 10/1978 | Jacobs | 126/299 D |
| 4,124,021 | 11/1978 | Molitor | 126/299 E |
| 4,125,148 | 11/1978 | Molitor | 126/299 E X |

*Primary Examiner*—Albert J. Makay
*Assistant Examiner*—Harold Joyce

[57] ABSTRACT

A method of supplying tempered makeup air to a room in conjunction with a grease extraction ventilator disposed above cooking equipment in the room and having removal means for removing grease and smoke particles and the like from air mixed with products of cooking, which includes removing heated air and the remaining products of cooking, after passage through the removal means, through a discharge duct; tempering fresh air in a heat exchanger and discharging the tempered fresh air into the room; passing incoming air to the discharge duct in a manner which automatically regulates the amount of exhaust and makeup air required to remove and replace the minimal amount of outside air to eliminate heat, odors, smoke, gases, grease and dirt as the cooking load changes; and causing incoming air, which is not passed to the discharge duct, to become a portion of the tempered air for discharge into said room. The removal means may be water contact means and there may be heat exchange, at least indirectly, between water from the water contact means with at least a portion of the fresh air. Control of the passage of incoming air to the exhaust duct may be inversely in accordance with the temperature of the heated air and products of cooking, such as measured adjacent the entrance of the exhaust duct and/or the entrance of the grease extraction ventilator. The apparatus corresponds to the method, but may further include an inlet duct for fresh air and a bypass duct between a fresh air plenum chamber and the exhaust duct.

24 Claims, 8 Drawing Figures

METHOD OF AND APPARATUS FOR EXHAUST CONTROL AND SUPPLYING TEMPERED MAKEUP AIR FOR A GREASE EXTRACTION VENTILATOR

This invention relates to exhaust control and suppling tempered makeup air in conjunction with a grease extraction ventilator.

BACKGROUND OF THE INVENTION

The method and apparatus of this invention are improvements upon the apparatus for tempering makeup air of my U.S. Pat. No. 4,124,021, which discloses a grease extraction ventilator which includes a water bath or water sprays into or through which are directed the air and other gases rising from cooking equipment. This water is pumped through a heat exchanger for a portion of incoming makeup air which is directed into the room, while the remainder of the makeup air is directed toward the intake of the ventilator, to reduce the amount of air withdrawn from the room by the suction blower. The heat exchanger may also be utilized at a desired location, within or outside of the room in which the ventilator is installed, to heat or cool air or other fluids for heating or other purposes. Makeup air is directed into the upper portion of the room, such as through a horizontal slot adjacent the ceiling. An air chamber opposite the ventilator has a front wall and a lower discharge outlet on the rear side, which directs makeup air toward the ventilator intake. To reduce an undesired flow of air from the lower edge of the front wall, which may produce a flow of smoke and the like into the room, an orifice adjacent the horizontal slot may direct makeup air downwardly along the front wall of the air chamber.

Haried U.S. Pat. No. 3,194,308, directed to a cross flow heat exchanger with ducts in the panel, discloses a heat exchanger through which is passed exhaust air from the drying apparatus of a dry cleaning establishment, to heat a heat transfer medium which is then circulated through another heat exchanger, through which makeup air for the dry cleaning establishment is passed. One example of the heat transfer medium is water which includes an anti-freeze.

Among the objects of this invention are to provide a novel method and apparatus for tempering makeup air through utilization of the heating or cooling effect of water contacted by air and products of cooking equipment, passed through a water contact means of a grease extraction ventilator; to provide such a method and apparatus by which the maximum effectiveness of the waste energy may be secured; to provide such a method and apparatus which may be essentially automatically controlled; to provide such a method and apparatus in which supplemental heat and cooling for extreme conditions may be provided; to provide such a method and apparatus which operates efficiently and effectively; and to provide such apparatus which may be constructed in a convenient and relatively economical manner.

SUMMARY OF THE INVENTION

The method of this invention is particularly adapted to be carried out by the apparatus thereof, which includes a grease extraction ventilator having means for removing grease and smoke particles and the like from air mixed with products of cooking, for example, water contact means, such as constructed in accordance with my U.S. Pat. No. 3,841,062. Such apparatus may include a makeup air device having one or more heat exchangers through which at least a portion of the makeup air may be passed and which involves the transfer of heat from or to the water contact means of the grease extraction ventilator. In the preferred construction, one or more heat exchangers through which such water is passed are adapted to either heat or cool a heat transfer medium, which is then supplied to one or a series of heat exchangers through which makeup air is passed. A principal feature of this invention is a bypass means, such as a duct having a damper control, by which varying amounts of makeup air may be bypassed to the discharge duct of the grease extraction ventilator. In accordance with this invention, the amount of makeup air transferred by the bypass means is varied inversely in accordance with the temperature of the air and products of cooking at the exhaust duct after passage through water contact means of the grease extraction ventilator. A temperature responsive control device may be positioned within the grease extraction ventilator, such as just below the entrance of or within the exhaust duct and utilized to control the flow through the bypass means. A second temperature responsive control device may be placed at the inlet of the grease extraction ventilator, in order to smooth out fluctuations in control of flow through the bypass duct, activated by the first control thermometer adjacent the discharge duct. In order to avoid freezing in extremely cold weather, the heat transfer medium circulated between the first and second heat exchangers, is preferably a solution resistant to freezing, such as a solution of an antifreeze, such as ethylene glycol, and water. The makeup air device may also discharge a portion of the makeup air laterally in the upper portion of the room in which the grease extraction ventilator is located, while another portion of the makeup air is directed downwardly for flow around and beneath a depending leg at the front of the makeup air device for flow to the cooking equipment and particularly to the intake of the grease extraction ventilator.

The bypass control of this invention automatically regulates the amount of exhaust and makeup air required to remove and replace the minimum amount of outside air to eliminate heat, odors, smoke, gases, grease and dirt as the cooking load changes. Also, any air which is not bypassed to the exhaust duct becomes a portion of the tempered air discharged into the room.

THE DRAWINGS

DESCRIPTION OF THE PREFERRED EMBODIMENT

Figure 1:
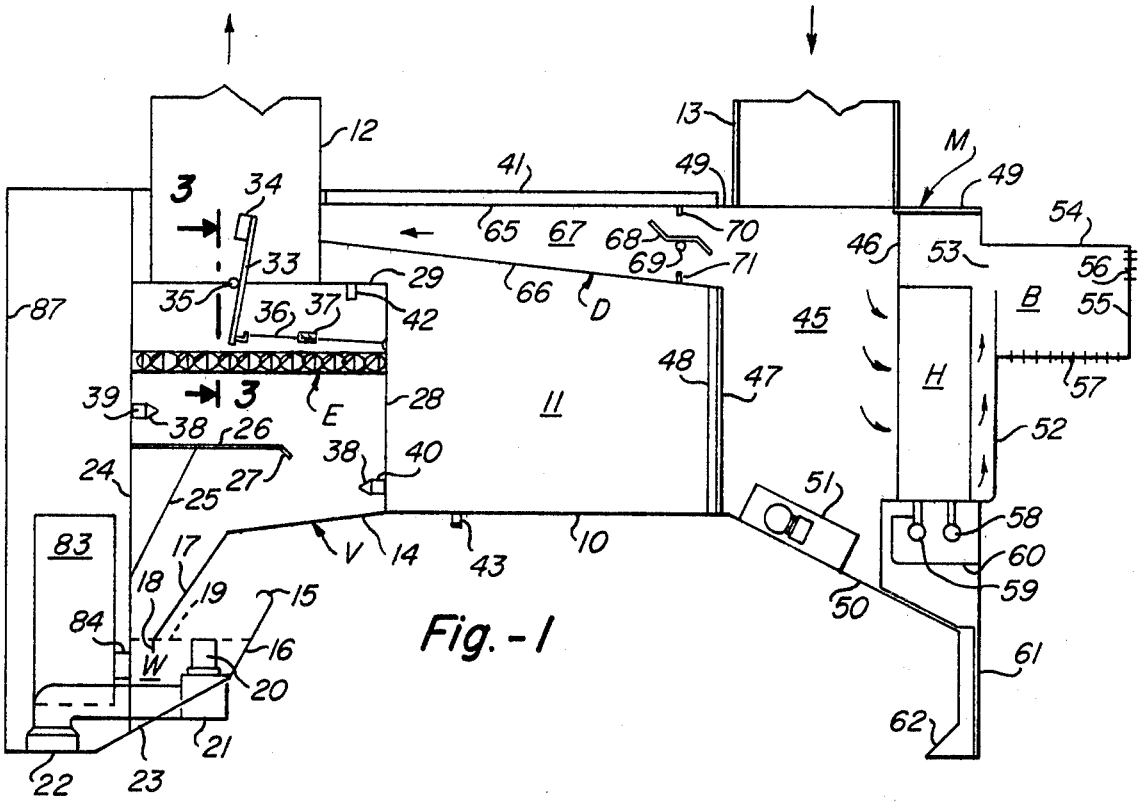
FIG. 1 is a diagrammatic cross section of a combined grease extraction ventilator and makeup air device constructed in accordance with this invention and particularly adapted to carry out the method of this invention.

A preferred embodiment of this invention, as illustrated in the drawings, is applied to the combination of a grease extraction ventilator V and a makeup air device M of FIG. 1, similarly to my U.s. Pat. No. 4,124,021. A panel 10 connects the adjacent lower portions of the two devices, beneath a space 11 in which certain equipment is installed, as described later. The heated air and products of cooking, such as grease, smoke and the like, as well as makeup air, are drawn through the grease extraction ventilator V by a conventional exhaust fan placed at the end of an outlet duct 12, flow therethrough being in the direction of the arrow shown. A conventional intake fan (not shown) is also provided at a suitable location for pulling makeup air from the atmosphere, for passage through an intake duct 13 which leads to the top of the makeup air device M and flow through which is in the direction of the arrow shown.

The heated air and products of cooking, from cooking equipment which is disposed below the grease extraction ventilator V, in a conventional manner, may flow upwardly toward panel 10 and a rearwardly and slightly downwardly inclined plate 14, for flow through an entrance space between a curved lip 15, at the upper end of a front wall 16, and an angular baffle 17 having a depending lip 18 at its lower end. Lip 18 and a portion of baffle 17 may be adjusted upwardly or downwardly, as in my U.S. Pat. No. 3,841,062. The makeup and heated air and products of cooking engage a water bath W, maintained at a level indicated by the dotted line 19 through an adjustable overflow pipe 20, mounted on a hollow base 21 which is connected with an overflow outlet 22. The water bath is maintained between front wall 16, a sloping bottom wall 23 and a rear wall 24, which extends upwardly to the position of the lower end of outlet duct 12.

Figure 4:
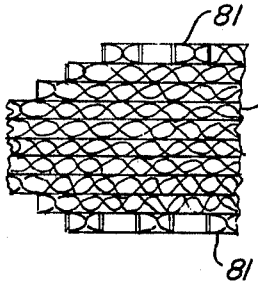
FIG. 4 is a fragmentary section, on a further enlarged scale, taken at the position of line 4—4 of FIG. 3.
Figure 5:
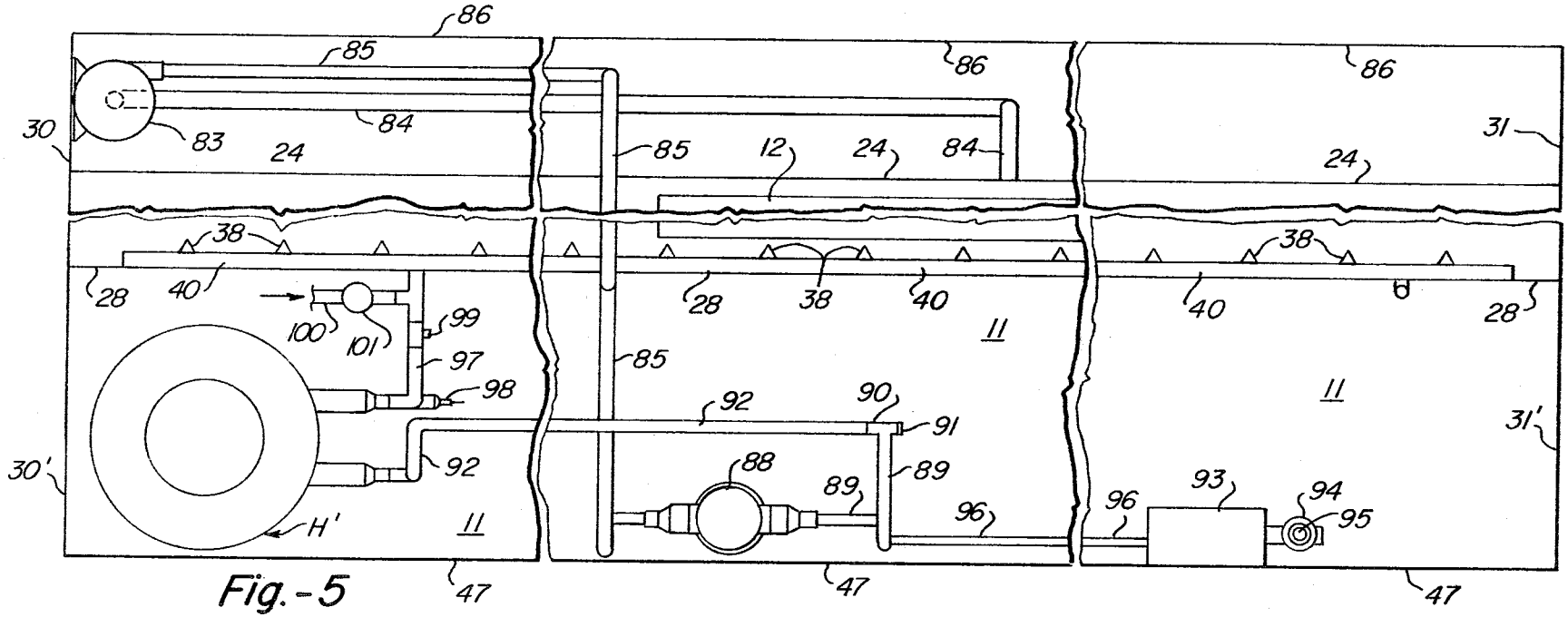
FIG. 5 is a diagrammatic top plan view of the piping and equipment associated with the circulation of liquid from a water bath of the grease extraction ventilator through a heat exchanger which produces a heated or cooled liquid for heat exchange with incoming air.

The mixture of incoming air and products of cooking agitate the water bath, the amount of agitation being determined by the normal level of the water bath and the position of the lip 18, which is adjusted for the normal flow conditions during cooking. After passage around lip 18, the gaseous stream, which tends to be stripped of grease particles and the like by passage through the water bath, moves upwardly against an angular baffle 25, which extends upwardly and forwardly from rear wall 24, then impinges against a horizontal baffle 26 having a downwardly extending lip 27 at its front end. As the gaseous stream passes around lip 27, it tends to be stripped of additional particulates and also condensed droplets of moisture, then passes upwardly through an enlarged passageway between rear wall 24 and a front wall 28. Before passage through duct 12, the gaseous stream engages a mist eliminator E, the preferred construction of which is described below in connection with FIGS. 3 and 4. A top wall 29 of this passage extends across the width of the grease extraction ventilator V to side walls 30 and 31 of FIG. 5, while duct 12 occupies a portion only of the width of the ventilator V, as indicated in FIG. 5. A fire damper 33 having a weight 34, on its upper end when in the open position shown, is pivoted on a pin 35 and is held in open position by a wire 36 having installed therein a fuse link 37, which is adapted to melt in the event of the temperature being sufficiently high to be indicative of a fire. This permits the weight 34 to move the damper 33 to closed position across the lower end of duct 12. A series of spray nozzles 38 are mounted on a supply tube 39 mounted on rear wall 24 above baffle 26, while a similar series of spray nozzles 38 are mounted on a supply tube 40 mounted on front wall 28 below the position of the lower end of lip 27. The nozzles 38 return the water to the water bath W, after circulation in accordance with this invention as described later, and also wash down the walls on which grease or similar material, which may condense after passage through the water bath, may collect. Material particulates which settle to the bottom of the water bath may be removed periodically through a conventional drain (not shown), while floating grease tends to be removed by the overflow pipe 20. An upper panel 41 provides a top for space 11 and extends between the tops of ventilator V and makeup air device M.

In accordance with this invention, a first temperature responsive control device or control thermometer 42, which measures the temperature of the gaseous stream flowing into the discharge duct 12, is mounted on the underside of the top wall 29 of the ventilator gaseous stream space adjacent duct 12. A second and optional control thermometer 43, which measures the temperature of heated air and products of cooking flowing to the throat section of the ventilator, may be mounted on the underside of panel 10, adjacent plate 14. In accordance with this invention, control thermometer 42, or both control thermometers 42 and 43, may be utilized to monitor the flow through a bypass duct D, as described later.

The incoming makeup air passes from duct 13 into a plenum space 45, which is bounded by a front wall 46, a rear wall 47 provided with insulation 48, a top wall 9, which is also insulated, and a downwardly angular bottom wall 50. Duct 13 may generally have a width corresponding to duct 12, the width of which is shown in FIG. 5, while the plenum space 45 extends to side walls 30' and 31', as in FIG. 7. At one or more positions, bottom wall 50 may be provided with a light box 51 for illuminating the cooking area. A series of heat exchangers H, which extend across the width of plenum space 45, as in FIG. 7, receive makeup air which flows therethrough from the plenum space, as indicated by the arrows of FIG. 1, and is discharged on the opposite side to flow upwardly, as also indicated by arrows, through a space between the front of each heat exchanger H and a front panel 52, thence through an outlet 53 below top wall 49. From outlet 53, the heated or cool makeup air flows into a laterally elongated discharge box B having a top plate 54 and a front plate 55, a portion of which is provided with louvered openings 56 for discharge of a portion of the makeup air into the room along the ceiling to pass downwardly at positions spaced from the makeup air device M. The rear of discharge box B is provided by the upper end of front panel 52, while a bottom plate is provided with louvered openings 57 for directing treated air downwardly. A heated or cooled, nonfreezing glycol solution is supplied to and discharged from each heat exchanger H by headers 58 and 59, respectively, which extend within a drain box 60 placed below the heat exchangers to carry away any accidental leakage. Below the lower end of inclined bottom wall 50, a double walled leg 61 extends downwardly to direct gaseous air flowing downwardly through louvers 57 toward the cooking area. Leg 61 is provided with a foot 62 extending rearwardly, to insure that the makeup air flowing under leg 61 is directed angularly upwardly toward panel 10 for passage along plate 14 and into the throat section of the grease extraction ventilator V.

In further accordance with this invention, bypass duct D, of converging shape, as shown, extends between the upper end of the plenum space 45 to the discharge duct 12, for bypassing a portion of the makeup air in order to utilize, to the greatest extent, the heating effect of the heat energy produced by the air and products of cooking rising from the cooking equipment. Thus, when the temperature at control thermometer 42, just below discharge duct 12, is at its highest, little or no makeup air is bypassed through duct D, since there should be sufficient heat contained in the water bath circulated through heat exchanger H' of FIG. 5, as described hereinafter, to heat the maximum amount of makeup air passing through heat exchanger H of FIGS. 1 and 7. However, if the temperature of the exhaust gases at control thermometer 42 should decrease, a bypass of makeup air through duct D is started, since a decrease in the exhaust temperature indicates less heat energy available for heating incoming makeup air. Similarly, if the temperature of the exhaust gases at thermometer 42 should continue to decrease, a greater amount of makeup air is bypassed through duct D. When the temperature of the exhaust gases at control thermometer 42 is at a minimum, indicating that the cooking equipment is not turned on and that there would be little or no heat available for heating makeup air, the amount of makeup air bypassed through duct D should be at a maximum.

Figure 2:
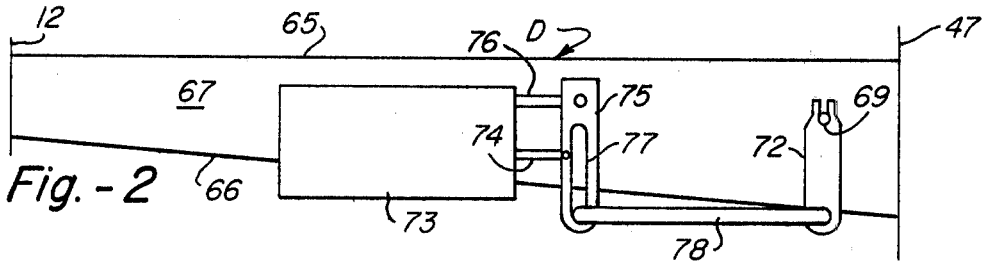
FIG. 2 is a side elevation, on an enlarged scale, of a bypass duct of FIG. 1.

Bypass duct D is provided with a top wall 65, an inclined bottom wall 66 and side walls 67, with the side walls being spaced apart the same distance as the side walls of duct 12. Within duct D, a damper 68, each end of which may be angular, is mounted for pivotal movement on a central pivot rod 69. The ends of the damper are engageable with an upper stop 70 and a lower stop 71, inside the duct D, when the damper is in closed position. The damper is shown in open position in FIG. 1, which corresponds to the position of pivot rod 69 and an arm 72 attached thereto of FIG. 2. The damper is opened and closed, as well as moved to different intermediate positions, by a conventional reversible motor assembly 73, the motor of which may be stopped in any desired position or rotated in any direction. The motor turns a nut, inside the assembly, which engages the threaded end of a rod 74 which is pivotally connected to an arm 75. In turn, arm 75 is pivotally mounted on a bracket 76 carried by the motor assembly and provided with a slot 77 along which one laterally extending end of a link 78 may be adjusted in a conventional manner, to correspond with the dimensions and positions of the damper 68. The other laterally extending end of link 78 fits into a hole (not shown) in arm 72.

For illustration purposes, assume that when all of the cooking equipment is operating at full heating capacity and the maximum amount of heat is being exhausted through the water bath W and the gases passed on through the exhaust duct 12, a temperature of 200° F. at the throat between lip 15 and baffle 17 of FIG. 1 is produced, so that the exhaust temperature at control thermometer 42 will be on the order of 90° F. In this condition, no makeup air will be passed through duct D. However, assume that the throat temperature between lip 15 and baffle 17 drops to 150° F. and the exhaust temperature at control thermometer 42 then drops to 80° F. Under such circumstances, the amount of makeup air bypassed through duct D will be increased, until the exhaust temperature remains steady. Similarly, assume that the throat temperature is reduced to 100° F. and the exhaust temperature drops to between 70° F. and 75° F., the amount of makeup air will be further decreased until the exhaust temperature again becomes steady. Further assume that the room is at a temperature of 70° F. when the cooking equipment is off and the exhaust fans are first turned on and that the exhaust temperature is then between 65° F. and 68° F., the maximum amount of air is bypassed through the duct D. Thus, when the exhaust and intake fans are first turned on, which is necessary prior to starting the cooking equipment, the controls are set so that the damper 68 is fully open and the amount of bypass air flowing through duct D is at a maximum. However, as the cooking equipment heats up and the temperature at control thermometer 42 increases, the damper 68 is closed in increments until, when the cooking equipment is producing a maximum temperature at control thermometer 42, the damper 68 will be fully closed. Intermediate positions of damper 68 will, of course, depend on the exhaust temperatures. It will be evident, when the exhaust of control thermometer 42 stabilizes, the amount of bypass air should remain substantially constant. The control thermometer 43 may be utilized to reduce fluctuations produced by control thermometer 42. Thus, the control thermometer 43 may be utilized to override the control thermometer 42, in the event that a stable temperature has been reached at control thermometer 43 but not yet at control thermometer 42.

As will be evident, when the incoming makeup air which is passed into the room and including that which flows through the louvres of plate 57 downwardly and around the lower end of leg 61 toward the cooking equipment and also toward the throat between lip 15 and baffle 17, corresponds in amount to the heat available for heating purposes, not only is the maximum proportion of the available heat used without the necessity of supplemental heat, as in a manner described later, but also the comfort of those attending the cooking equipment will be sustained at less expense.

When the outside temperature becomes higher than the room temperature, no essential change will be necessary in the controls, even though at higher temperatures at control thermometer 42, it is logical that there would be less cooling effect for warm or hot outside air. However, the more heat that is produced by the cooking equipment, the higher the temperature at the cooking equipment and the less cooling which is necessary for the comfort of the operators. Also, a greater volume of makeup air directed toward the operators increase their comfort. Assume that the cooking equipment is operating at maximum capacity and produces a temperature of 100° F. adjacent it, then air blowing against the operators at 90° F. temperature will feel cool. Similarly, if the cooking equipment produces a temperature of 90° F. adjacent it, then air blowing against the operators at 80° F. temperature will feel cool, and similarly for air at 80° F. produced by the cooking equipment and air blown against the operators at 70° F. Also, if the cooking equipment is producing little heat, then a small amount of air, cooled by the lower temperature water, will suffice to provide comfort. Thus, with the smallest amount of makeup air being bypassed through duct D at the highest temperature at the entrance to discharge duct D and the amount of air bypassed being greatest for the lowest temperature at the entrance to discharger duct D, the maximum comfort of the operators is secured.

Figure 3:
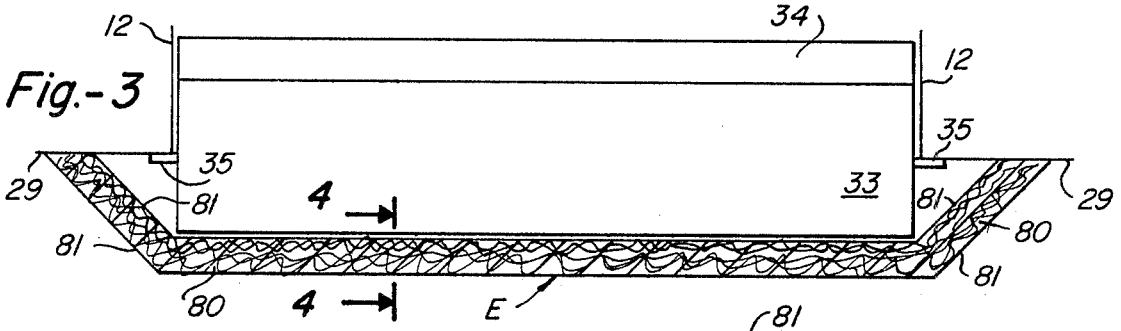
FIG. 3 is a section, on an enlarged scale, taken along line 3—3 of FIG. 1.

The mist eliminator E extends not only between the walls 24 and 28 of the exhaust fluid space of the ventilator V, as in FIG. 1, but also past each side of the outlet duct 12, as in FIG. 3. As shown in detail in FIG. 4 and diagrammatically in FIG. 3, the mist eliminator E may be formed from a series of woven wire mesh layers 80 which intercept water or other liquid droplets to remove them from the gaseous fluid passing therethrough, while mesh layers 80 are held in place by a covering 81 of expanded metal. The mist eliminator is attached to the underside of top wall 29 at opposite sides of an opening of duct 12, as in FIG. 3, in a suitable manner and also abuts against the walls 24 and 28. The edges of eliminator E may be originally produced with a flat area 82, as shown at the left in FIG. 4, better to engage the walls 24 and 28.

Figure 6:
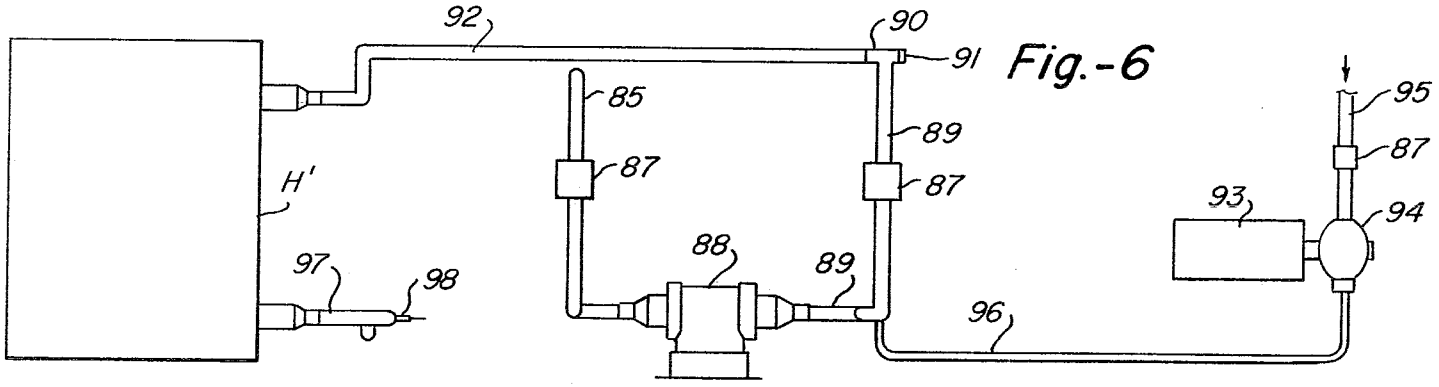
FIG. 6 is a similar elevation of the piping and equipment of FIG. 5.

As in FIGS. 1 and 5, a combined pump and motor 83 may be mounted on the inside of side wall 30 of the ventilator, as in FIG. 5, with an inlet pipe 84 extending to a water bath suction connection at the center of the ventilator, a portion of the latter being shown in FIG. 1. A pump discharge pipe 85 extends toward the center of the ventilator, as in FIG. 5, within the space in which the motor pump 83 is located, provided by a rear wall 86 of the ventilator. Pipe 85 may extend upwardly through the top 41, along the top to space 11, then downwardly into the space 11 and across the space 11 to a position adjacent the front wall 47, then downwardly again. A heat exchanger H' is located in space 11 and is preferably of the type disclosed in my copending application Ser. No. 122,305 filed Feb. 19, 1980, as a division of my application Ser. No. 920,660 filed June 30, 1978. As disclosed therein, the heat exchanger consists of one or more sets of spiral coils which are placed in abutting relation and in compression engagement with an inner cylinder and an outer cylinder surrounding the outermost coil, so that a spiral path is formed between turns of laterally abutting coils. A first liquid, for heating or cooling a second liquid, is passed through the spiral coils while the second liquid is circulated through the spiral passage. In the present instance, the first liquid is supplied by the pump 83, from the water bath of the grease extraction ventilator, and is pumped through the laterally abutting coils, while the second liquid is an aqueous solution of ethylene glycol with a proportion of ethylene glyco-sufficient to prevent freezing at the temperature of the incoming air during the coldest winter day expected to be encountered in the heat exchanger H of FIG. 1. Pipe 85 extends downwardly past a check valve 87, as in FIG. 6, and longitudinally to a strainer 88, mounted on panel 10. From strainer 88, a pipe 89 extends longitudinally, then laterally and upwardly past another check valve 87 and thence to a tee 90, in which is installed a temperature sensor 91. From tee 90, a pipe 92 extends to the heat exchanger H', near the top thereof.

In further accordance with this invention, a modulating control 93 operates a valve 94 which may be supplied with hot water by a pipe 95 through another check valve 87. When the outside temperature is sufficiently low that the fluid from the water bath will not heat the incoming air sufficiently, additional hot water may be supplied through valve 94 and a hot water supply tube 96 which extends to the bottom of the upright leg of pipe 89. The hot water supplied by tube 96 mixes with the water bath fluid and increases the temperature to which the glycol solution will be heated during passage through heat exchanger H'.

After passage through the heat exchanger H', the discharge water passes through a pipe 97, near the bottom of the heat exchanger, for return to the water chamber through the distribution tube 40 and nozzles 38, with a branch pipe (not shown) extending to distribution tube 39 and its nozzles 38 of FIG. 1. Discharge pipe 97 is provided with a freeze stat bulb 98 and a water pressure switch connection 99. Makeup water for the water bath may be delivered through a pipe 100 having a check valve 101 therein and connected to pipe 97 for flow to the water bath through nozzles 38 supplied by tubes 39 and 40.

Figure 7:
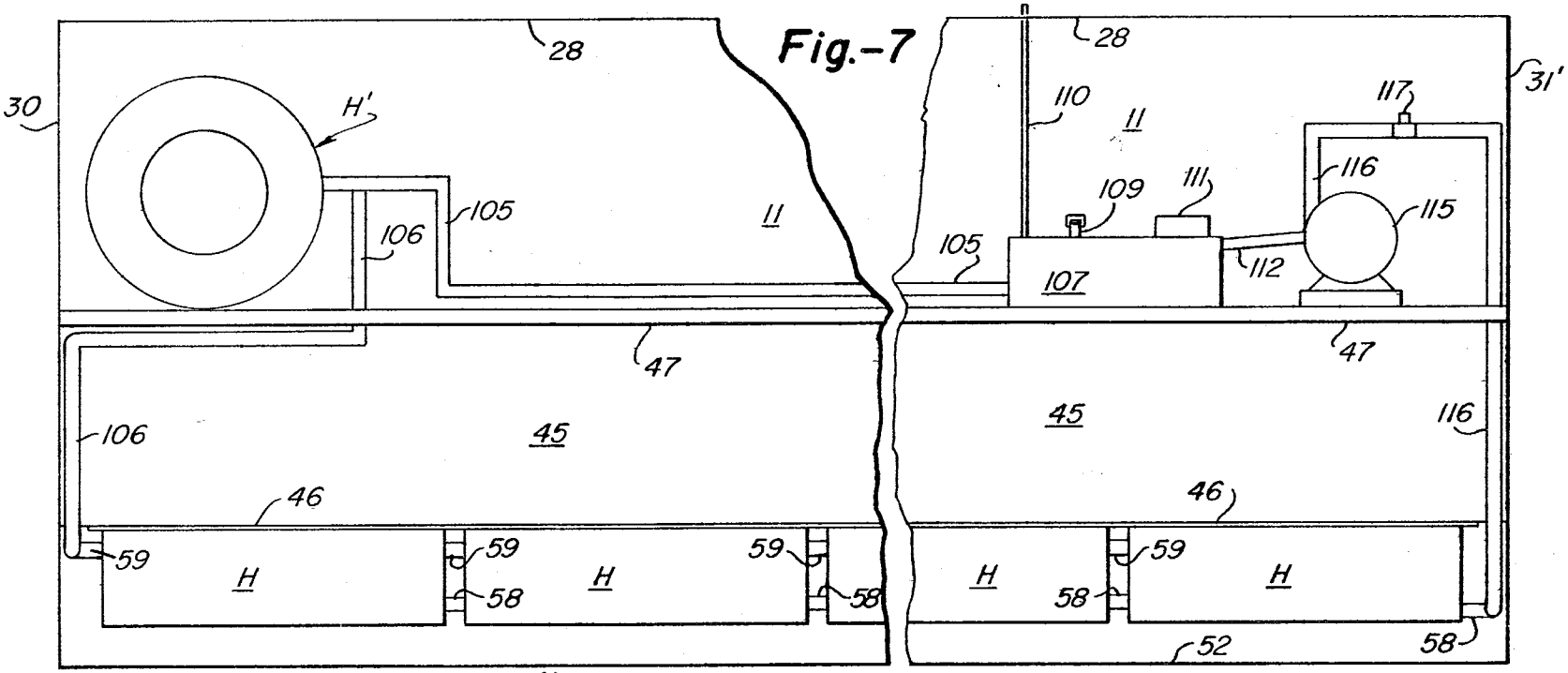
FIG. 7 is a diagrammatic top plan view of the piping and equipment associated with the circulation of a heated or cooled liquid from the heat exchanger of FIGS. 5 and 6 through a series of heat exchangers which heat or cool makeup air.
Figure 8:
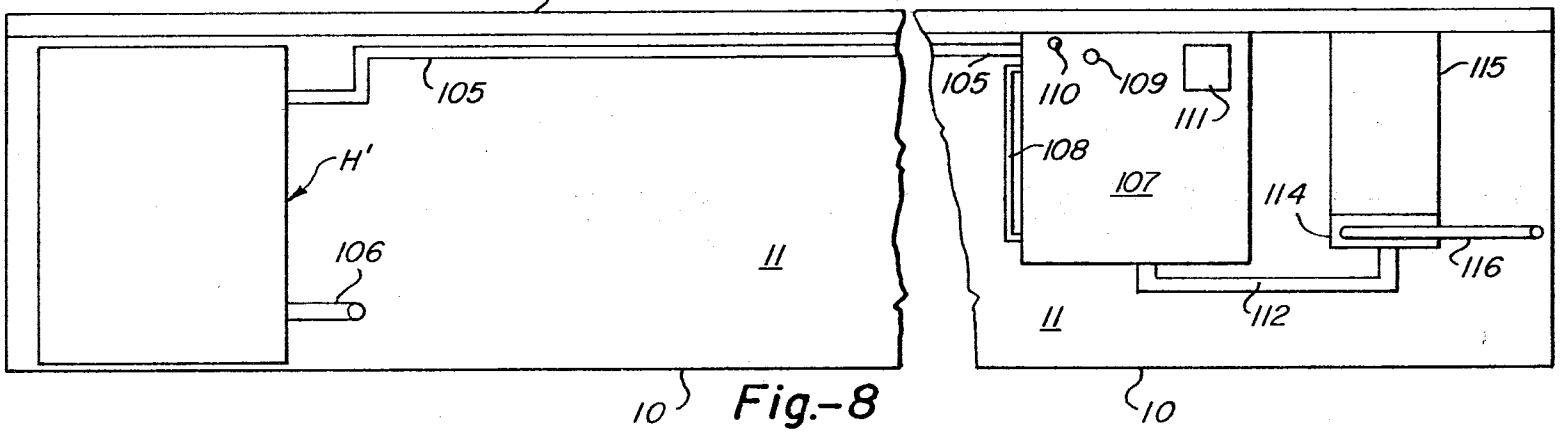
FIG. 8 is a similar elevation of the piping and equipment of FIG. 7.

As illustrated in FIGS. 7 and 8, the heated or cooled glycol solution is circulated between heat exchangers H' and the series of air to liquid heat exchanger H of FIGS. 1 and 7. It will be understood that the piping and equipment installed in space 11 and shown in FIGS. 5 and 6, other than heat exchanger H', is interspaced with that shown in FIGS. 7 and 8. Since the flow of liquid being heated or cooled in the heat exchanger H' is counter-current to the liquid from the water bath and supply pipe 92 of FIGS. 5 and 6 enters the near the top and discharge pipe 97 leaves near the bottom, a heated or cooled glycol solution outlet pipe 105 leaves near the top and a return flow pipe 106 enters near the bottom of heat exchanger H'. Treated liquid pipe 105 extends within the upper portion of pipe 11 to a glycol solution tank 107, which is mounted on wall 47 within space 11. Glycol solution tank 107 is provided with a sight gage 108 which is utilized in determining the liquid level, when filling or replenishing the solution through a filling connection 109, as well as a small pressure relief tube 110, which may overflow into the ventilator by extending through wall 28. A housing 111 for a liquid level switch is also mounted on the glycol solution tank, to indicate that the level is low and the tank needs makeup solution. Parts 109, 110, and 111 are shown in FIG. 8 on the opposite side of the tank than they are actually installed, for ease of illustration. A pipe 112 connects the bottom of tank 107 with the center of the underside of a pump 114 driven by a motor 115, with a tangential discharge pipe 116 looping around the pump, past a pressure switch connection 117. Pipes 116 extends across a portion of space 11, adjacent side wall 31, through wall 47 and across plenum space 45 for connection with inlet pipe 58, which supplies each of the counter flow heat exchangers H, which are connected in parallel. After flow through the respective heat exchangers, the glycol solution is returned through pipe 59 and thence to pipe 106 adjacent side wall 30'. Pipe 106 extends across plenum space 45, then laterally to the position shown in FIG. 7 and through wall 47 for connection to heat exchanger H' near its lower end, as in FIG. 8.

It will be understood that variations may be utilized in both the method and apparatus of this invention. For instance, control thermometer 43 may be utilized along to control bypass damper 68, inversely in accordance with variations in temperature of the heated gases and products of cooking. Preferably, the temperature of the latter is measured either before engagement with the water contact means, such as the water bath, or after the moisture eliminator E, in order to avoid a "wet bulb" effect which might introduce some inaccuracy into the readings. Cooled water, such as produced by a conventional refrigeration machine, may be supplied to feed pipe 95 instead of heated water, when the temperature of the outside air is considerably higher than room temperature and insufficient cooling to produce a desire temperature is available from the water from the water contact means. The freeze stat bulb 98 may operate on a specific gravity principle and may be connected with an alarm or meter, to indicate when the concentration of anti-freeze becomes low. When freezing is not a problem, the water from the water contact means may be circulated through the heat exchangers H, as by connecting pipe 85 of FIG. 5 with pipe 58 of FIG. 7 and connecting pipe 59 of FIG. 7 with pipe 97 of FIG. 5.

It will be further understood that other embodiments of this invention may exist and that numerous changes and variations may be made, in addition to those referred to, without departing from the spirit and scope of this invention.

What is claimed is:

1. A method of supplying tempered makeup air to a room in conjunction with a grease extraction ventilator disposed above cooking equipment in said room and having removal means for removing grease and smoke particles and the like from air mixed with products of cooking, which comprises:

causing heated air and products of cooking from said cooking equipment to pass through said removal means of said grease extraction ventilator;

removing said heated air and remaining products of cooking, after passage through said removal means, through a discharge duct;

conducting fresh air through an intake duct to heat exchange means for tempering the same;

discharging the tempered fresh air into said room;

establishing a source of incoming air;

passing incoming air to said discharge duct inversely in accordance with the temperature of said heated air and products of cooking; and causing incoming air, which is not passed to said discharge duct, to become a portion of said tempered air for discharge into said room.

2. A method as defined in claim 1, including:

controlling the passage of incoming air to said exhaust duct inversely in accordance with the temperature measured adjacent the entrance of said discharge duct.

3. A method as defined in claim 1, including:

controlling the passage of incoming air to said discharge duct inversely in accordance with the temperature measured above said cooking equipment prior to engagement of said heated air and products of cooking with said removal means.

4. A method as defined in claim 2, including:

measuring the temperature of said heated air and products of cooking adjacent the intake of said discharge duct; and controlling the amount of incoming air supplied to said discharge duct generally inversely to the aforesaid temperature measurements but secondarily to temperature measurements above said cooking equipment prior to engagement of said heated air and products of cooking with said removal means.

5. A method as defined in claim 1, wherein:

said removal means of said grease extraction ventilator comprises water contact means;

said incoming air supplied to said discharge duct comprises a portion of said fresh air; and effecting, at least indirectly, an exchange of heat between water of said water contact means and at least a portion of such fresh air in said heat exchange means.

6. A method as defined in claim 5, including:

removing moisture droplets from said heated air and products of cooking after passage through said water contact means but prior to the entrance of said discharge duct.

7. A method as defined in claim 6, including:

controlling the passage of incoming air to said discharge duct inversely in accordance with the temperature between the area of removal of moisture droplets and the area adjacent the entrance of said discharge duct.

8. A method as defined in claim 5, including:

passing said water from said water contact means in heat exchange relationship with a heat transfer medium; and passing said heat transfer medium in heat exchange relationship with at least a portion of said fresh air for tempering the same.

9. A method as defined in claim 8, wherein:

said heat transfer medium contains an anti-freeze.

10. A method as defined in claim 8, including:

adding heated water to said water from said water contact means prior to heat exchange with said heat transfer medium to supplement the heat supplied by said water from said water contact means when the temperature of said fresh air is sufficiently below the temperature in said room that the amount of heat supplied through said water from said water contact means is insufficient to heat the heat transfer medium to a desired temperature.

11. A method as defined in claim 8, including:

adding cooled water to said water from said water contact means, prior to heat exchange with said heat transfer medium to supplement the cooling supplied by said water from said water contact means, when the temperature of said air is sufficiently above the temperature of said room that the amount of cooling supplied through said water contact means is insufficient to cool the heat transfer medium to a desired temperature.

12. Apparatus for supplying tempered makeup air to a room in conjunction with a grease extraction ventilator disposed above cooking equipment in said room and having removal means for removing grease and smoke particles and the like from air mixed with products of cooking, which comprises:

a discharge duct having suction means for causing heated air and products of cooking to pass through said removal means of said grease extraction ventilator and for removing said heated air and remaining products of cooking, after passage through said removal means;

an intake duct having blower means for producing a flow of fresh air;

means for tempering at least a portion of such fresh air;

means for directing tempered fresh air into said room;

a bypass duct extending to said discharge duct;

means for supplying incoming air to said bypass duct;

means for controlling the flow of air through said bypass duct to said discharge duct;

means responsive to the temperature of said heated air and products of cooking for controlling the flow of air through said bypass duct to said discharge duct, inversely in accordance with such temperature; and means for causing incoming air which is not supplied to said discharge duct to become a portion of said tempered air.

13. Apparatus as defined in claim 12, wherein:

said temperature responsive means is responsive to the temperature adjacent the entrance of said discharge duct.

14. Apparatus as defined in claim 12, wherein:

said temperature responsive means is responsive to the temperature of said heated air and products of cooking prior to engagement thereof with said removal means.

15. Apparatus as defined in claim 12, including:

means for controlling the flow of air through said bypass duct primarily responsive to the temperature adjacent the entrance of said discharge duct and secondarily responsive to the temperature of said heated air and products of cooking prior to engagement thereof with said removal means.

16. Apparatus as defined in claim 12, wherein:

a damper in said bypass duct is moved to control the flow of air therethrough.

17. Apparatus as defined in claim 12, wherein:

said removal means comprises water contact means;

said incoming air supplied to said bypass duct comprises a portion of said fresh air; and means for effecting, at least indirectly, an exchange of heat between water of said water contact means and at least a portion of such fresh air.

18. Apparatus as defined in claim 17, including:

means for removing droplets of moisture from said heated air and products of cooking, after passage thereof through said water contact means but before passage thereof into said exhaust duct.

19. Apparatus as defined in claim 17, including:

first heat exchange means for effecting heat exchange between said water from said water contact means and a heat exchange medium;

second heat exchange means for effecting an exchange of heat between said heat exchange medium and said fresh air; and means for circulating said heat exchange medium between said first heat exchange means and said second heat exchange means.

20. Apparatus as defined in claim 19, wherein:

said heat transfer medium is liquid and contains an anti-freeze.

21. Apparatus as defined in claim 19, including:

a connection for adding supplemental water to said water from said water contact means between said water contact means and said first heat exchange means;

whereby heated water may be added to said water from said water contact means to supplement the heat supplied by said water from said water contact means, when the temperature of said fresh air is sufficiently below the temperature in said room that the amount of heat supplied through said water from said water contact means is insufficient to heat the heat transfer medium to a desired temperature; and whereby cooled water may be added to said water from said water contact means to supplement the cooling supplied by said water from said water contact means, when the temperature of said fresh air is sufficiently above the temperature in said room that the cooling supplied through said water from said water contact means is insufficient to cool the heat transfer medium to a desired temperature.

22. Apparatus as defined in claim 19, including:

means providing a water bath in said grease extraction ventilator and means for causing said heated air and products of cooking to engage said water bath;

baffle means above said water bath around which said heated gases and cooking products flow after engaging said water bath;

means for spraying returned water from said water bath into said ventilator adjacent said baffle means; and means for supplying said spraying means with said water after flow through said second heat exchange means.

23. A method of supplying tempered makeup air to a room in conjunction with a grease extraction ventilator disposed above cooking equipment in said room and having removal means for removing grease and smoke particles and the like from air mixed with products of cooking, which comprises:

causing heated air and products of cooking from said cooking equipment to pass through said removal means of said grease extraction ventilator;

removing said heated air and remaining products of cooking, after passage through said removal means, through a discharge duct;

conducting fresh air through heat exchange means for tempering the same;

discharging the tempered fresh air into said room;

establishing a source of incoming air;

passing incoming air to said discharge duct in a manner which automatically regulates the amount of exhaust and makeup air required to remove and replace the minimum amount of outside air to eliminate heat, odors, smoke, gases, grease and dirt as the cooking load changes; and causing incoming air, which is not passed to said discharge duct, to become a portion of said tempered air for discharge into said room.

24. Apparatus for supplying tempered makeup air to a room in conjunction with a grease extraction ventilator disposed above cooking equipment in said room and having removal means for removing grease and smoke particles and the like from air mixed with products of cooking, which comprises:

a discharge duct having suction means for causing heated air and products of cooking to pass through said removal means of said grease extraction ventilator and for removing said heated air and remaining products of cooking, after passage through said removal means;

an intake duct having blower means for producing a flow of fresh air;

means for tempering at least a portion of such fresh air;

means for directing tempered fresh air into said room;

a bypass duct extending to said discharge duct;

means for supplying incoming air to said bypass duct;

means for controlling the flow of air through said bypass duct to said discharge duct;

means for controlling the flow of air through said bypass duct in a manner which automatically regulates the amount of exhaust and makeup air required to remove and replace the minimum amount of outside air to eliminate heat, odors, smoke, gases, grease and dirt as the cooking load changes; and means for causing incoming air which is not supplied to said discharge duct to become a portion of said tempered air.

* * * * *